United States Patent [19]

Schad

[11] Patent Number: 5,005,510

[45] **Date of Patent: * Apr. 9, 1991**

[54] HIGH STRENGTH BOAT HULL STRUCTURE

[76] Inventor: Robert D. Schad, 110 Bloor Street West, Suite 2104, Toronto, Ontario, Canada

[ * ] Notice: The portion of the term of this patent subsequent to Jan. 9, 2007 has been disclaimed.

[21] Appl. No.: 451,580

[22] Filed: Dec. 18, 1989

[51] Int. Cl.[5] ..... B63B 5/24

[52] U.S. Cl. ..... 114/357; 114/343; 114/359

[58] Field of Search ..... 114/11, 12, 357, 359, 114/343

[56] References Cited

U.S. PATENT DOCUMENTS

| | | | |
|---|---|---|---|
| 36,546 | 9/1862 | Wood | 114/12 |
| 530,024 | 11/1894 | D'Humy | 114/12 |
| 2,617,126 | 11/1952 | Nebesar | 114/357 |
| 4,365,580 | 12/1982 | Blount | 114/359 |
| 4,667,619 | 5/1987 | Nishida | 114/357 |
| 4,892,055 | 1/1990 | Schad | 114/357 |

FOREIGN PATENT DOCUMENTS

| | | | |
|---|---|---|---|
| 123584 | 9/1980 | Japan | 114/357 |
| 1805 | of 1860 | United Kingdom | 114/12 |
| 1275 | of 1861 | United Kingdom | 114/12 |
| 656340 | 8/1951 | United Kingdom | 114/357 |
| 1591580 | 6/1981 | United Kingdom | 114/357 |

*Primary Examiner*—Sherman Basinger
*Assistant Examiner*—Thomas J. Brahan
*Attorney, Agent, or Firm*—Bachman & LaPointe

[57] ABSTRACT

A high strength impact resistant hull structure including method of manufacture is disclosed having inner and outer skins wherein the outer skin comprises a plurality of wearstrips keyed to one another and keyed to the inner skin.

6 Claims, 2 Drawing Sheets

HIGH STRENGTH BOAT HULL STRUCTURE

BACKGROUND OF THE INVENTION

The present invention relates to the structure and method of manufacture of boat hulls which are highly resistant to impact failure when operating in difficult navigational or amphibious situations.

More particularly the hull structure is one which is intended to be useful in travel over ice, snow, growlers, ice floes, short spans of land, water containing floating debris or submerged objects.

Use of the language boat hull is intended to include pontoons used on aircraft, bridge structures or floating docks.

SUMMARY OF THE INVENTION

It is a primary feature of the present invention to provide a boat hull and a method of manufacture which is highly resistant to impact.

A further feature of the invention is the provision of a boat hull having an inner and an outer skin where the outer skin is of high strength and is wear resistant.

A further feature of the invention is the provision of a hull structure in which the outer skin takes the form of a plurality of wear strips interlocked to one another and interlocked to the inner skin in a unique manner to form a unitary structure.

A further feature of the invention involves a novel method of "laying up" a hull structure using a plurality of interlocked wear strips fabricated of a high strength polymer where the wear strips (outer skin) serve as a base or mold into which layers of fiberglass reinforced plastic (inner skin) are laid up to form a composite hull structure.

It is a further feature of the invention to provide first and second key means between the inner and outer skins to interlock the skins together along at least two hull axes.

It is a still further feature of the invention to provide a third key means operable to interlock margins of the wear strips.

A hull structure embracing certain features of the present invention may comprise a hull body defining an inner skin fabricated of fiberglass reinforced plastic material, at least one wear strip defining an outer skin fabricated of a high strength polymer extending longitudinally of said hull body, a first key means connecting said strip to said hull body to preclude relative motion between the strip and the hull body in a first direction, and, a second key means connecting said wear strip and said hull body to preclude relative motion between the wear strip and the hull body in a second direction whereby said wear strip is fixed permanently to the hull body.

A method of fabricating an impact resistant boat hull structure embracing certain other features of the invention may comprise the steps of supporting at least one elongated, batten-like, wear strip in a jig, fixture or mold of the type used to lay up a fiberglass reinforced plastic skin, said wear strip having an internal rail or rib interrupted by cutouts, and, applying layers of fiberglass reinforced plastic material upon said mold and upon said wear strip so that a composite body is developed wherein the rail and the cutouts mesh with said reinforced plastic material to define a first and a second key means.

Other features and advantages of the present invention will become more apparent from an examination of the succeeding specification when read in conjunction with the appended drawings, in which;

DESCRIPTION OF THE PREFERRED EMBODIMENTS

Figure 1:
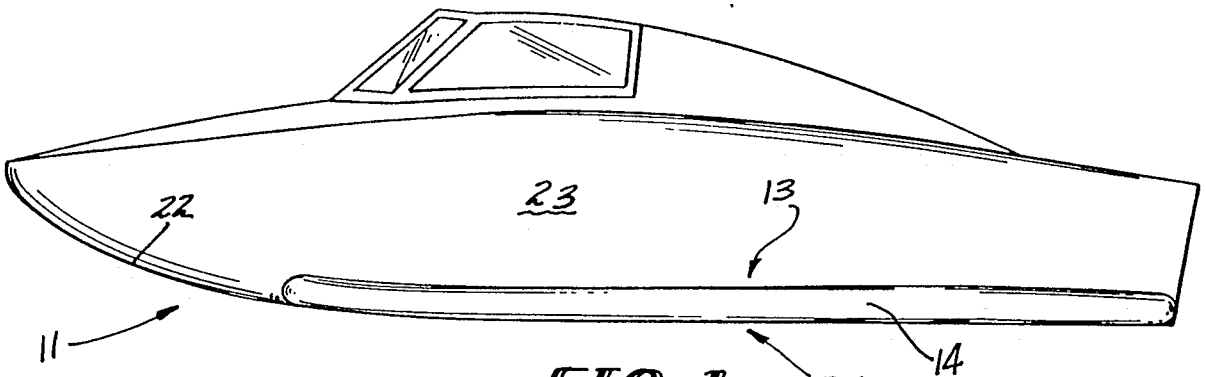
FIG. 1 is a side elevational view of a hull structure embracing principles of the present invention.
Figure 2:
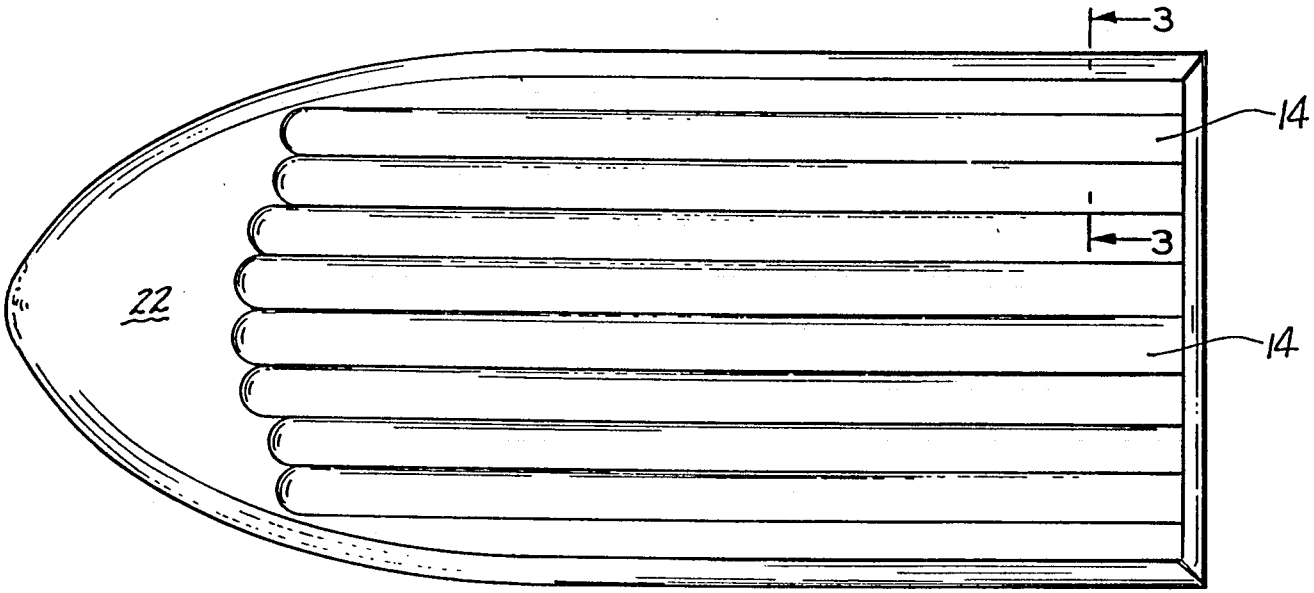
FIG. 2 is a plane view of the bottom side or outer skin of the hull of FIG. 1.

Referring in detail to the drawings the reference numeral 11 designates a hull structure having an inner skin 12 and an outer skin 13.

The inner skin is fabricated of fiberglass reinforced plastic such as a mixture of chopped glass fibers and a suitable binder or resin.

The outer skin 13 is composed of a plurality of wear strips 14 fabricated of ultra, high molecular weight polyethylene.

Figure 3:
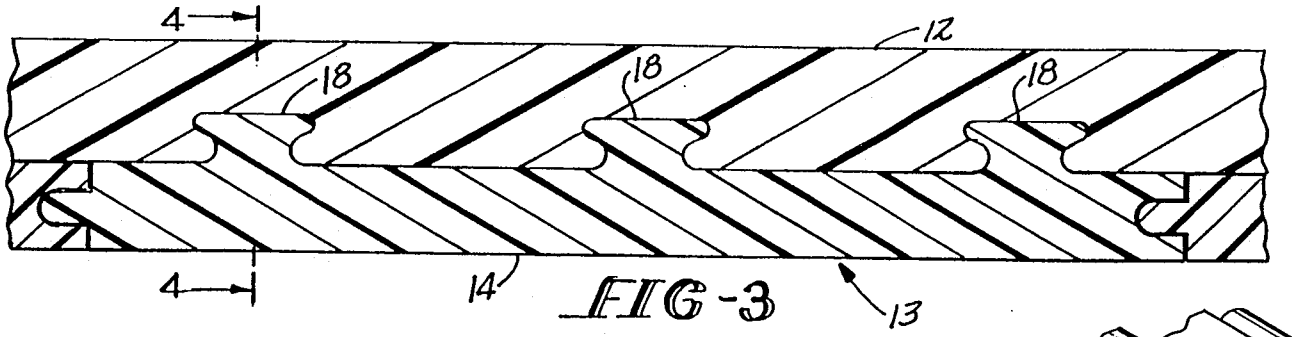
FIG. 3 is a sectional view of a portion of inner and outer skin, as viewed in the plane of the line 3—3 and in the direction of the arrows, illustrating details of a typical wear strip and the first and third key means.

The wear strips 14 abut one another and the side margins thereof are formed with a tongue 16 and a groove 17 to facilitate interlocking adjacent wear strips as is most apparent in FIG. 3.

A mating tongue 16 and groove 17, for purposes of claiming the invention, define a third key means.

Obviously the third key means is not limited to a tongue and groove connection; the showing is merely an exemplary embodiment of one practical connector.

The wear strips 14 are further formed with at least one elongated rail or dovetail 18 (three dovetails are shown in the wear strip of FIG. 3).

When the inner skin 12 is laid up upon a bed of wear strips, (see FIG. 6), the dovetail 18 is keyed to the inner skin 12 to define a first key means as is most apparent in FIG. 3.

Figure 5:
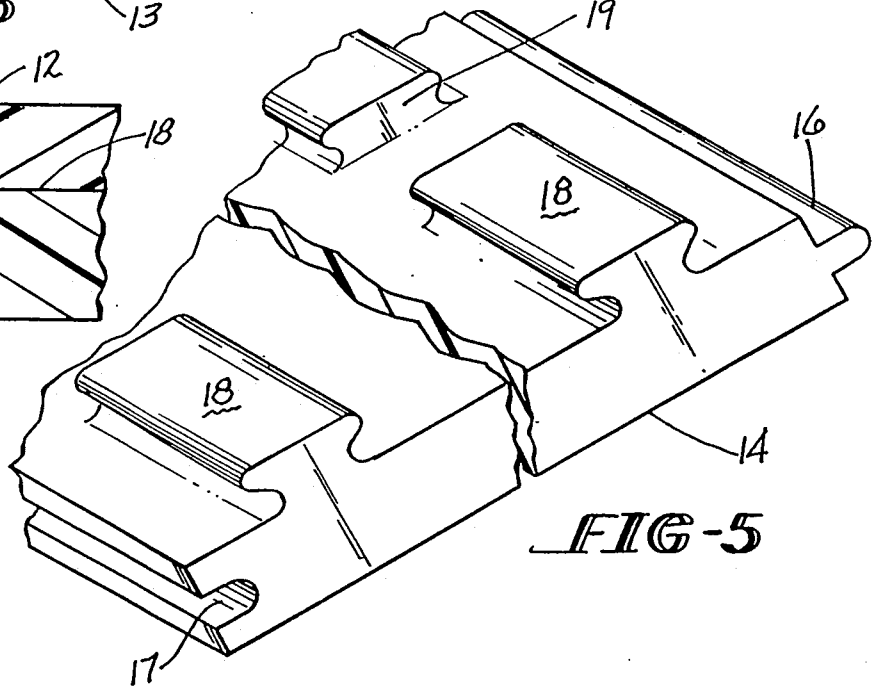
FIG. 5 is a perspective view of a portion of a wear strip.
Figure 4:
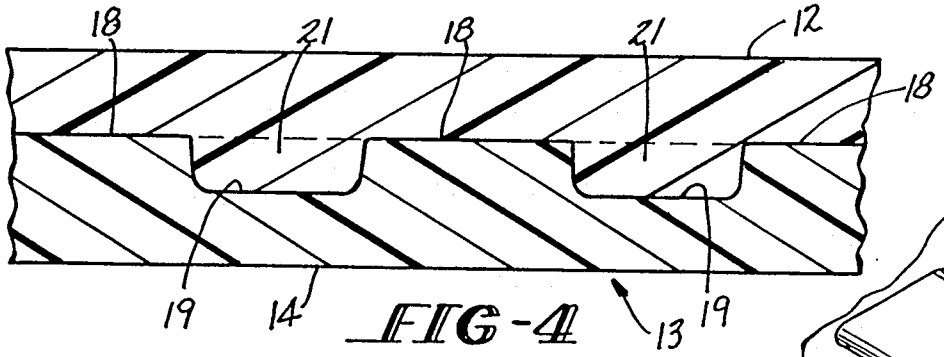
FIG. 4 is a vertical section of FIG. 3 in the plane of the line 4—4, as viewed in the direction of the arrows, showing the second key means.

Referring to FIGS. 4 and 5, it is apparent that the rails or dovetails 18 are interrupted by cutouts or notches 19 at spaced intervals to permit the development of mating projections 21 extending from the inner skin (as the inner skin is laid up), as is most apparent in FIG. 4. The cutouts 19 and the projections 21 define the second key means.

The chopped fiberglass-resin mixture is stuffed and pressed by hand into the notches 19 and about the rails 18 to insure good distribution and good keying between inner and outer skins.

Figure 6:
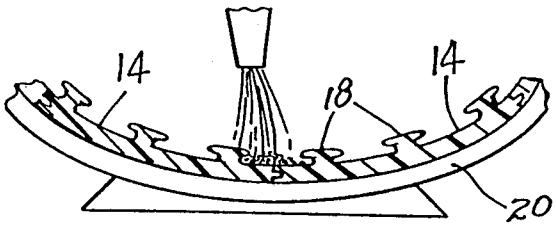
FIG. 6 is a schematic illustration of a typical hull jig or mold comprising a bed of wear strips supported in a frame.

As shown in FIG. 6, the hull structure is developed by supporting a plurality of interconnected (the tongue and groove connection) wear strips 14 in a suitable frame 20 so that the dovetails 18 project inwardly as shown in FIG. 3. Thereafter the inner skin 12 is laid up (layered) upon the bed of wear strips to create the composite laminate shown in FIGS. 3 and 4 in well-known fashion.

Obviously the frame 20 supporting the wear strips must be sufficiently extensive to serve as a mold for the bow portion 22 and the hull side walls 23 which extend beyond the bed of wear strips.

In certain hull designs, it is desirable to extend the wear strips 14 part way up the side wall of the hull beyond the turn of the bilge as shown at 24 in FIG. 1.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A method of fashioning an impact resistant boat hull structure comprising the steps of:

supporting at least one elongated, batten-like, wear strip in a frame of the type used to lay up a fiberglass reinforced plastic skin, said wear strip having an internally projecting rail or rib interrupted by cutouts, and, applying layers of fiberglass reinforced plastic material upon said frame and upon said wear strip so that a composite body is developed wherein the rail and the cutouts mesh with said reinforced plastic material to define a first and a second key means.

2. The method of claim 1 plus the step of supporting a plurality of wear strips in said frame and interlocking adjacent margins of said wear strips.

3. The method of claim 1 wherein the internally projecting rail defines a dovetail in cross-section.

4. The method of claim 1 wherein the wear strip defines an outer skin and the fiberglass reinforced plastic defines an inner skin.

5. The method of claim 1 wherein the wear strip is fabricated of an ultra high strength polyethylene.

6. The method of claim 1 wherein the fiberglass reinforced plastic material is stuffed and pressed into the notches and about the rail manually.

* * * * *